US011957989B2

(12) United States Patent
Kotsugai

(10) Patent No.: US 11,957,989 B2
(45) Date of Patent: Apr. 16, 2024

(54) CONTROL SYSTEM, CONTROL METHOD, AND PROGRAM

(71) Applicant: SONY INTERACTIVE ENTERTAINMENT INC., Tokyo (JP)

(72) Inventor: Yoshinori Kotsugai, Tokyo (JP)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 247 days.

(21) Appl. No.: 17/610,384

(22) PCT Filed: Jun. 4, 2020

(86) PCT No.: PCT/JP2020/022167
§ 371 (c)(1),
(2) Date: Nov. 10, 2021

(87) PCT Pub. No.: WO2020/250809
PCT Pub. Date: Dec. 17, 2020

(65) Prior Publication Data

US 2022/0241680 A1 Aug. 4, 2022

(30) Foreign Application Priority Data

Jun. 10, 2019 (JP) ..... 2019-107857

(51) Int. Cl.
*A63F 9/14* (2006.01)
*A63F 9/24* (2006.01)
(Continued)

(52) U.S. Cl.
CPC ..... *A63F 9/143* (2013.01); *A63F 9/24* (2013.01); *A63H 11/00* (2013.01); *A63H 30/04* (2013.01); *A63F 2009/2435* (2013.01)

(58) Field of Classification Search
CPC .... A63F 9/143; A63F 9/24; A63F 2009/2435; A63F 2009/2447; A63F 2009/247;
(Continued)

(56) References Cited

U.S. PATENT DOCUMENTS

2015/0196839 A1 7/2015 Ehrman

FOREIGN PATENT DOCUMENTS

JP H1071276 A 3/1998
JP H11244515 A 9/1999
(Continued)

OTHER PUBLICATIONS

English machine translation of WIPO publication WO/2018/025467 by Nakayama, et al.*
(Continued)

*Primary Examiner* — Michael C Grant
(74) *Attorney, Agent, or Firm* — XSENSUS LLP

(57) ABSTRACT

In a case where an actual object is moved by a user manipulation or by other means, physical phenomena associated with the object are addressed. A control system includes a mobile apparatus being an apparatus that moves on a sheet where images indicating coordinates are arranged and having a camera for photographing part of the sheet. The control system acquires the user manipulation, controls the mobile apparatus in such a manner as to travel according to the user manipulation (S106), detects a position of the mobile apparatus on the basis of an image photographed by the camera included in the mobile apparatus (S101), determines, on the basis of the position detection by position detection means, whether or not the mobile apparatus has moved in a manner estimated on the basis of the user manipulation (S102, S105), and performs a predetermined
(Continued)

procedure (S103, S110, S111) in a case where it is determined that the mobile apparatus does not move in the estimated manner.

16 Claims, 13 Drawing Sheets

(51) Int. Cl.
*A63H 11/00* (2006.01)
*A63H 30/04* (2006.01)

(58) Field of Classification Search
CPC ..... A63F 2009/2485; A63F 2009/2486; A63F 9/14; A63H 11/00; A63H 30/04; A63H 17/395; A63H 11/10; A63H 18/02; A63H 17/40

USPC ..... 463/38
See application file for complete search history.

(56) References Cited

FOREIGN PATENT DOCUMENTS

| | | |
|---|---|---|
| JP | 2017161770 A | 9/2017 |
| WO | 2018025467 A1 | 2/2018 |

OTHER PUBLICATIONS

International Search Report and Written Opinion dated Aug. 11, 2020, from PCT/JP2020/022167, 11 sheets.

ソニー株式会社 _ おもちゃで遊ぶ楽しさが、子どもたちの創意工夫で大きく広がるトイ プラットフォム「t o i o」を2017年12月に発売、本日より先行予約販売開始 ,Internetarchive waybackmachine,Internet Archive, Jun. 1, 2017, URL:https://web.archive.org/web/20170601051305/https://www.sony.co.jp/SonyInfo/News/Press/201706/17-058/,[Jul. 31, 2020],pp. 1-5,(SONY Corp), non-official translation "Toy platform 'toio', which will let children's creativity expand the fun of playing with toys, to be realeased Dec. 2017;Pre-order starts today."),5 sheets.

伊藤有_予約即日完売！新発表のおもちゃ「t o i o」に込められたソニーの革新的技術 ,Business Insider Japan, 株式会社 メディアジン, Jun. 2, 2017, URL: https://www.businessinsider. jp/post-34081, [retrieved Jul. 31, 2020], pp. 1-9, non-official translation (ITO, Yu, "Same day reservation is sold out! Sony's innovative technology in the new toy 'toio'"), 9 sheets.

* cited by examiner

CONTROL SYSTEM, CONTROL METHOD, AND PROGRAM

TECHNICAL FIELD

The present invention relates to a control system, a control method, and a program.

BACKGROUND ART

There are, for example, games such as racing games in which images of objects such as cars and obstacles are output and a user manipulates his or her own object by looking at the images thereof. The presence or absence of interaction such as collision between an object manipulated by the user and another object and an obstacle is virtually detected by a program, and a detection result thereof is reflected in an image or sound output.

PTL 1 discloses travel of a self-propelled device manipulated by the user on a mat.

CITATION LIST

Patent Literature

[PTL 1]
PCT Patent Publication No. WO2018/025467

SUMMARY

Technical Problem

The present inventor and others have created a game in which a mobile apparatus including a drive mechanism such as a motor is moved on the basis of user manipulation and another game in which a mobile apparatus moved by a program is provided in addition to an apparatus manipulated by a user for competition. In a case where a real apparatus is moved, it is necessary to take into consideration actual physical phenomena. Physical phenomena include, for example, replacement of the apparatus moved by the program and the apparatus manipulated by the user at different locations, tipping-over of these apparatuses, collision of these apparatuses with an obstacle or another object moved by a program, and other phenomena that occur due to external causes as well as physical movement of the mobile apparatuses. Because of difficulty involved in accurately controlling the mobile apparatuses by controlling the drive mechanism alone, it is not easy to detect a physical positional relation between the mobile apparatus moved by the program and the apparatus manipulated by the user. It has been difficult to properly control the games because of these physical phenomena.

The present invention has been devised in light of the foregoing, and it is an object of the present invention to provide a technology that allows physical phenomena to be addressed in a case where an actual object is moved by a user manipulation or by other means.

Solution to Problem

In order to solve the above problem, a control system according to the present invention includes a mobile apparatus being an apparatus that moves on a sheet where images indicating coordinates are arranged and having a camera for photographing part of the sheet, manipulation acquisition means adapted to acquire a manipulation of the user, travel control means adapted to perform control in such a manner that the mobile apparatus travels according to the manipulation of the user, position detection means adapted to detect a position of the mobile apparatus on the basis of an image photographed by the camera included in the mobile apparatus, determination means adapted to determine, on the basis of the position detection by the position detection means, whether or not the mobile apparatus has moved in a manner estimated the basis of the manipulation the user, and execution means adapted to perform a predetermined procedure in a case where it is determined that the mobile apparatus does not move in the estimated manner.

Also, a control method according to the present invention includes a step of acquiring a manipulation of the user, a step of performing control in such a manner that a mobile apparatus having a camera for photographing part of a sheet where images indicating coordinates are arranged travels on the sheet according to the manipulation of the user, a step of detecting a position of the mobile apparatus on the basis of an image photographed by the camera included in the mobile apparatus, a step of determining, on the basis of the position detection of the mobile apparatus, whether or not the mobile apparatus has moved in a manner estimated on the basis of the manipulation of the user, and a step of performing a predetermined procedure in a case where it is determined that the mobile apparatus does not move in the estimated manner.

Also, a program according to the present invention causes a computer to function as manipulation acquisition means adapted to acquire a manipulation of the user, travel control means adapted to perform control in such a manner that a mobile apparatus having a camera for photographing part of a sheet where images indicating coordinates are arranged travels on the sheet according to the manipulation of the user, position detection control means adapted to control detection of a position of the mobile apparatus, the detection being based on an image photographed by the camera included in the mobile apparatus, determination means adapted to determine, on the basis of the position detection by the position detection control means, whether or not the mobile apparatus has moved in a manner estimated on the basis of the manipulation of the user, and execution means adapted to perform a predetermined procedure in a case where is determined that the mobile apparatus does not move in the estimated manner.

In an embodiment of the present invention, the determination means may determine, on the basis of the position detected by the position detection means, whether or not the mobile apparatus has moved in a manner estimated on the basis of the manipulation of user.

In an embodiment of the present invention, the mobile apparatus may further include a sensor adapted to detect whether or not the mobile apparatus has collided with another object, the determination means may determine, on the basis of output of the sensor, whether or not the mobile apparatus has collided with the another object, and the execution means may perform a predetermined procedure in a case where it is determined that the mobile apparatus does not move in the estimated manner and that the mobile apparatus has collided with the another object.

In an embodiment of the present invention, the execution means may perform control in such a manner that the mobile apparatus is rotated and that an orientation of the mobile apparatus falls, after rotation of the mobile apparatus, within a predetermined directional range on the sheet, in a case where it is determined that the mobile apparatus does not move in the estimated manner and that the mobile apparatus has collided with the another object.

In an embodiment of the present invention, the control system may further include another mobile apparatus having a camera for photographing part of the sheet. The position detection means may detect a position of the another mobile apparatus on the basis of an image photographed by the camera included in the another mobile apparatus.

In an embodiment of the present invention, the determination means may determine, on the basis of the position of the mobile apparatus manipulated by the user and the position of the another mobile apparatus, whether or not the mobile apparatus and the another mobile apparatus are in proximity to each other, the execution means may perform a first procedure in a case where it is determined that the mobile apparatus does not move in the estimated manner, that the mobile apparatus has collided with the another object, and that the mobile apparatus and the another mobile apparatus are in proximity to each other, and the execution means may perform a second procedure different from the first procedure in a case where it is determined that the mobile apparatus does not move in the estimated manner, that the mobile apparatus has collided with the another object, and that the mobile apparatus and the another mobile apparatus are not in proximity to each other.

In an embodiment of the present invention, the determination means may determine, on the basis of detection of another position of the another mobile apparatus by the position detection means, whether or not the mobile apparatus has moved in the manner estimated on the basis of the manipulation of the user, and the execution means may move the another mobile apparatus on the basis of proximity between the position of the mobile apparatus manipulated by the user and the position of the another mobile apparatus, in a case where it is determined that the another mobile apparatus has moved in the estimated manner.

In an embodiment of the present invention, the determination means may determine whether or not the position of the mobile apparatus has been detected by the position detection means, the execution means may output a message to instruct the user to arrange the mobile apparatus on the sheet and may calculate a return range the sheet on the basis of a last position of the mobile apparatus detected by the position detection means, in a case where the position of the mobile apparatus is not detected by the position detection means, and the execution means may output an error message in a case where the position of the mobile apparatus detected by the position detection means is not located within the return range after the instruction message has been output.

In an embodiment of the present invention, a plurality of return ranges may be printed on the sheet, and the execution means may select, on the basis of the last position of the mobile apparatus detected by the position detection means, return range from among the plurality of return ranges and output an instruction message indicating the selected return range.

Also, another control system according to the present invention includes a first apparatus and a second apparatus each being an apparatus that travels on a sheet where images indicating coordinates are arranged and each having a camera for photographing part of the sheet, manipulation acquisition means adapted to acquire a manipulation of the user, first travel control means adapted to perform control in such a manner that the first apparatus travels according to the manipulation of the user, position detection means adapted to detect a position of the first apparatus on the basis of an image photographed by the camera included in the first apparatus and detect position of the second apparatus on the basis of an image photographed by the camera included in the second apparatus, and second travel control means adapted to decide a destination of the second apparatus on the basis of the position of the first apparatus and the position of the second apparatus, the positions being detected by the position detection means, and control travel of the second apparatus on the basis of the decided destination.

In an embodiment of the present invention, the second apparatus may further include a sensor adapted to detect collision with another object, and the second travel control means may control the travel of the second apparatus further on the basis of a signal of the sensor.

According to the present invention, it is possible to address physical phenomena in a case where an actual object is moved by a user manipulation or by other means.

DESCRIPTION OF EMBODIMENT

A description will be given below of an embodiment of the present invention on the basis of drawings. Of components that appear, those having the same function will be denoted by the same reference sign, and the description thereof will be omitted. In the embodiment of the present invention, a mobile device that travels according to a user manipulation travels on a sheet.

Figure 1:
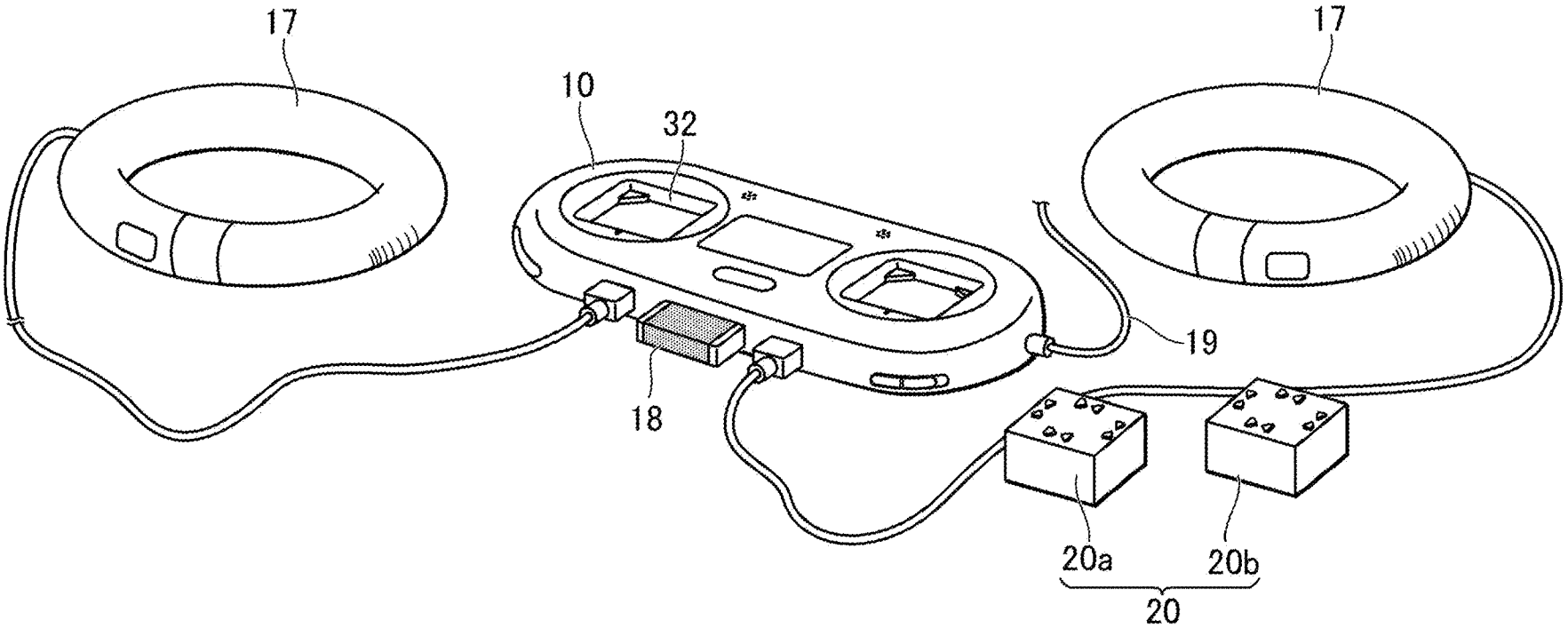
FIG. 1 is a diagram illustrating an example of a control system according to an embodiment of the present invention.

FIG. 1 is a diagram illustrating an example of a control system according to an embodiment of the present invention. The control system according to the present invention includes a device control apparatus 10, carts 20*a* and 20*b*, a controller 17, and a cartridge 18. Each of the carts 20*a* and

20*b* is a self-propelled mobile device including a camera 24, and the two carts have the same functions. In the description given below, the carts 20*a* and 20*b* will be denoted as carts 20 unless it is specifically necessary to distinguish between the two. The device control apparatus 10 wirelessly controls the carts 20. The device control apparatus 10 has recessed portions 32, and when the carts 20 are fitted into the recessed portions 32, the device control apparatus 10 charges the carts 20. The controller 17 is an input apparatus for acquiring a user manipulation and is connected to the device control apparatus 10 by a cable. The cartridge 18 incorporates a non-volatile memory.

Figure 2:
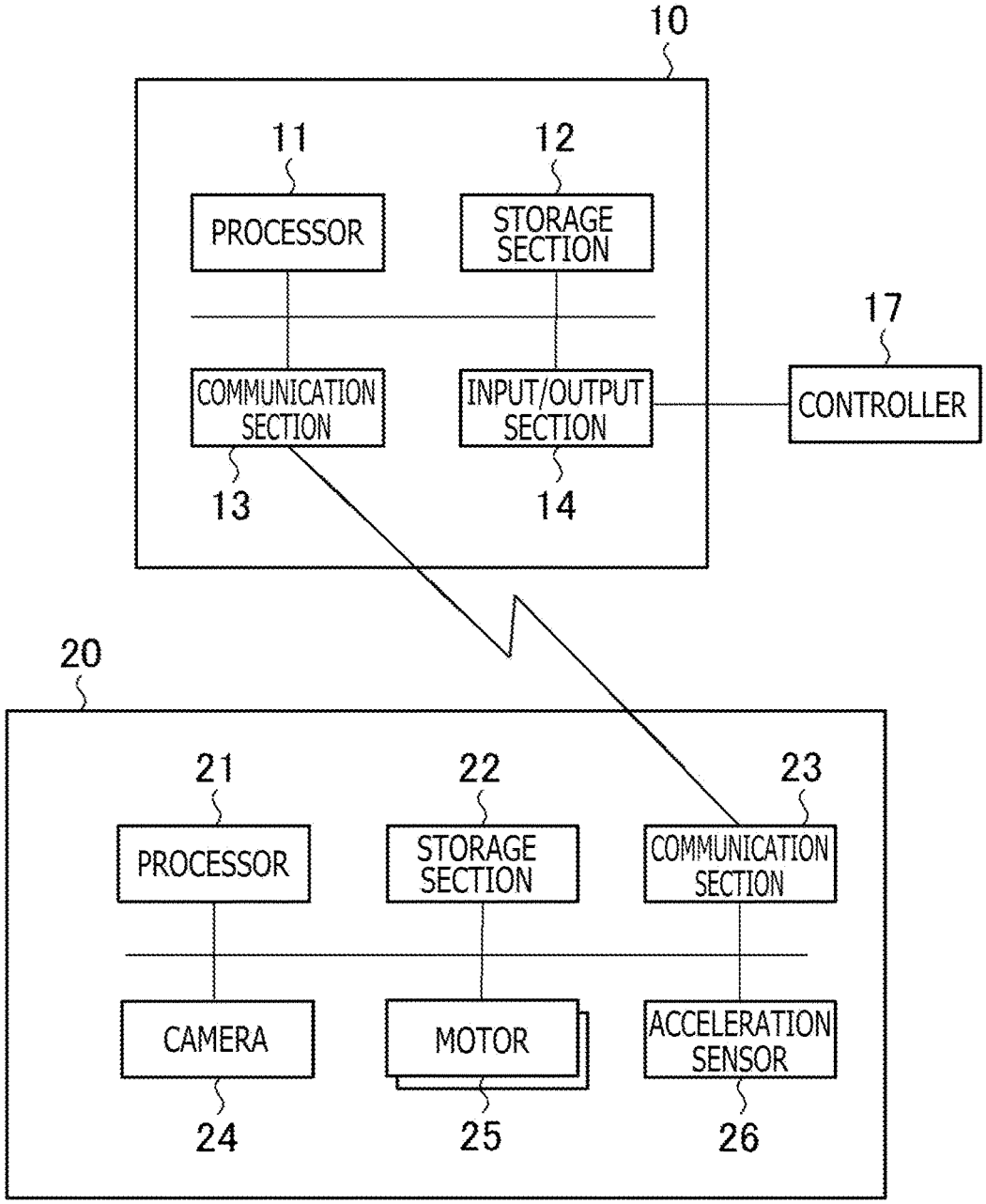
FIG. 2 is a diagram illustrating a hardware configuration of the control system.

FIG. 2 is a diagram illustrating a hardware configuration of the control system according to the embodiment of the present invention. The device control apparatus 10 includes a processor 11, a storage section 12, a communication section 13, and an input/output section 14. Each of the carts 20 includes a processor 21, a storage section 22, a communication section 23, the camera 24, two motors 25, and an acceleration sensor 26. The device control apparatus 10 may be a dedicated apparatus that has been optimized to control the carts 20 or may be a general-purpose computer.

The processor 11 operates according to a program stored in the storage section 12 and controls the communication section 13, the input/output section 14, and the like. The processor 21 operates according to a program stored in the storage section 22 and controls the communication section 23, the camera 24, the motors 25, and the like. Although stored and provided in a computer-readable storage medium such as a flash memory in the cartridge 18, the above programs may be provided via a network such as the Internet.

The storage section 12 includes a dynamic random access memory (DRAM) and a non-volatile memory incorporated in the device control apparatus 10, a non-volatile memory in the cartridge 18, and the like. The storage section 22 includes a DRAM, a non-volatile memory, and the like. The storage sections 12 and 22 store the above programs. Also, the storage sections 12 and 22 store information and computation results input from the processors 11 and 21, the communication sections 13 and 23, and the like.

Each of the communication sections 13 and 23 includes integrated circuitry, an antenna, and the like for communicating with other equipment. The communication sections 13 and 23 have a function to communicate with each other, for example, according to Bluetooth (registered trademark) protocols. The communication sections 13 and 23 input, under control of the processors 11 and 21, information received from other apparatuses to the processors 11 and 21 and the storage sections 12 and 22 and send information to other apparatuses. It should be noted that the communication section 13 may have a function to communicate with other apparatuses via a network such as a local area network (LAN).

The input/output section 14 includes circuitry for acquiring information from input devices such as the controller 17 and circuitry for controlling output devices such as a sound output device and an image display device. The input/output section 14 acquires an input signal from the input device and inputs, to the processor 11 and the storage section 12, information obtained by converting the input signal. Also, the input/output section 14 causes a speaker to output a sound and the display device to output an image under control of the processor 11 or the like.

The motors 25 are what are called servomotors whose direction, amount of rotation, and rotational speed are controlled by the processor 21. A wheel 254 is assigned to each of the two motors 25, and the motors 25 drive the assigned wheels 254.

The camera 24 is arranged to photograph an area below the cart 20 and photographs a pattern printed on a sheet 31 (refer to FIG. 4) on which the cart 20 is placed. In the present embodiment, the pattern recognized in an infrared frequency domain is printed on the sheet 31, and the camera 24 photographs an infrared image thereof.

The acceleration sensor 26 measures an acceleration exerted on the cart 20. The acceleration sensor 26 outputs a measured acceleration value. It should be noted that the acceleration sensor 26 may be integral with a gyrosensor.

Figure 3:
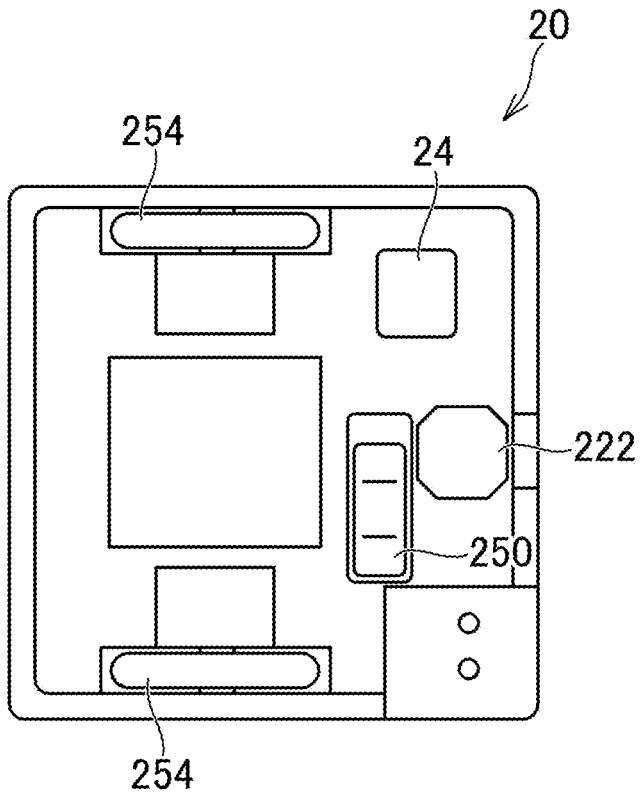
FIG. 3 a diagram illustrating an example of a cart.

FIG. 3 is a diagram illustrating an example of the cart 20. FIG. 3 is a view of the cart 20 as seen from below. The cart 20 further includes a power switch 250, a switch 222, and the two wheels 254.

Figure 4:
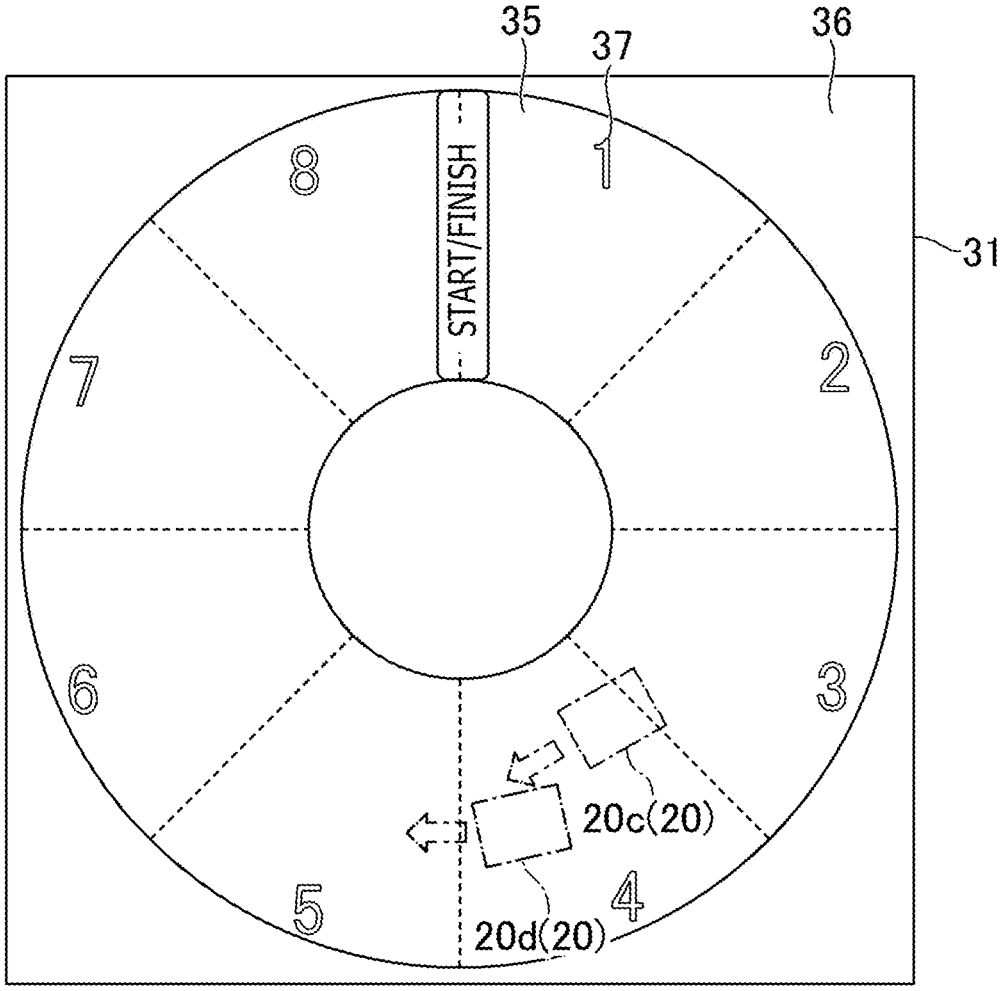
FIG. 4 is a diagram illustrating an example of a sheet.

FIG. 4 is a diagram illustrating an example of the sheet 31 on which the cart 20 is arranged. Not only an image that can be visually recognized by a user but also a pattern that can be photographed by the camera 24 are printed on the sheet 31.

In the example illustrated in FIG. 4, a donut-shaped travel-permitted region 35, a travel-prohibited region 36, and area codes 37 are printed on the sheet 31 in a visually recognizable manner. The travel-permitted region 35 is a region where the carts 20 can travel. The travel-prohibited region 36 is, of the regions on the sheet 31, a region other than the travel-permitted region 35, and the carts 20 are controlled by the control system in such a manner as not to travel in this region. The travel-permitted region 35 is divided into a plurality of partial regions by dashed lines in FIG. 4, and the area code 37 identifying each of the divided regions is printed in each of the divided regions. FIG. 4 illustrates a manipulated cart 20*c* and a controlled cart 20*d* that travel on the sheet 31. The manipulated cart 20*c* is the cart 20 that travels according to a steering manipulation and an acceleration/deceleration manipulation by the user. The controlled cart 20*d* is the cart controlled by the program on the basis of the current position and the position of the manipulated cart 20*c*.

A detailed description will be given of the pattern printed on the sheet 31 or the like. Unit patterns of a given size (e.g., 0.2 mm square) are arranged in a matrix shape on the sheet 31. Each of the unit patterns is an image obtained by coding the coordinates of the position where each of the pattern is arranged. Of a coordinate space that can be represented by the coded coordinates, a region corresponding to the size of the sheet 31 is assigned to the sheet 31.

In the control system according to the present embodiment, the unit pattern printed on the sheet 31 or the like is photographed by the camera 24 of the cart 20, and the cart 20 or the device control apparatus 10 acquires the coordinates by decoding the unit pattern. This allows the position of the cart 20 on the sheet 31 or the like to be recognized. Also, the cart 20 or the device control apparatus 10 also calculates an orientation of the cart 20 by detecting the orientation of the unit pattern in the image photographed by the camera 24.

This control system can recognize the position of the cart 20 on the sheet 31 or the like with high accuracy by using the patterns printed on the sheet 31 or the like without using any other device such as a stereo camera.

Figure 5:
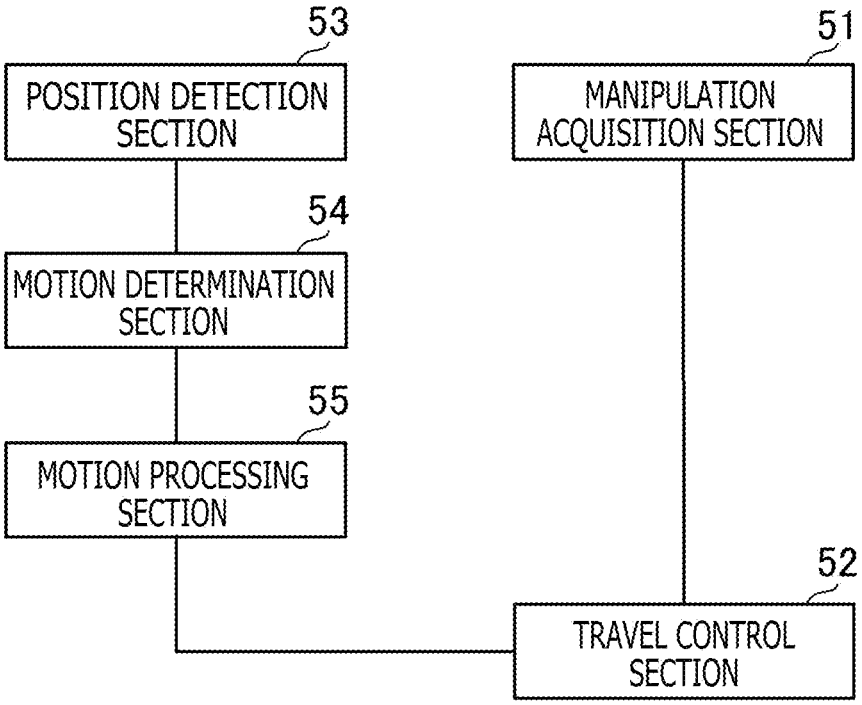
FIG. 5 is a block diagram illustrating functions realized by the control system.

A description will be given below of an operation of this control system. FIG. 5 is a block diagram illustrating the functions realized by the control system. The control system functionally includes a manipulation acquisition section 51, a travel control section 52, a position detection section 53, a motion determination section 54, and a motion processing section 55. The manipulation acquisition section 51, the travel control section 52, the position detection section 53, the motion determination section 54, and the motion processing section 55 are primarily realized as a result of execution of the program stored in the storage section 12 by the processor 11 included in the device control apparatus 10 and control over the cart 20 via the communication section 13. Also, some of the functions of the position detection section 53, the travel control section 52, and the like are realized as a result of execution of the program stored in the storage section 22 by the processor 21 included in the cart 20 and exchange of data with the device control apparatus 10 and control over the camera 24 and the motors 25 via the communication section 23.

The manipulation acquisition section 51 acquires a user manipulation from the controller 17 via the input/output section 14. The acquired user manipulation is, for example, a tilt of the controller, whether or not a button has been pressed, and a jog dial position. The manipulation acquisition section 51 acquires these manipulations, for example, as a steering manipulation, an acceleration manipulation, and a braking manipulation of the cart.

The travel control section 52 performs control in such a manner that the manipulated cart 20*c* travels according to the user manipulation. The manipulated cart 20*c* is any one of the carts 20, and the travel control section 52 changes the orientation of travel of the manipulated cart 20*c* according to the user manipulation corresponding to the steering manipulation of the user and increases and decreases a speed of travel of the manipulated cart 20*c* according to the user manipulations corresponding to the acceleration manipulation and the braking manipulation.

The position detection section 53 recognizes, from the image photographed by the camera 24 of the cart 20, the pattern obtained by coding the coordinates. The position detection section 53 detects the coordinates (position) where the cart 20 is located and the orientation thereof from the coordinates indicated by the pattern. Also, the processor 11 included in the device control apparatus 10 performs control, by executing an application program for realizing some of the functions of the position detection section 53, in such a manner that the coordinates (position) and the orientation are detected on the basis of the photographed image, and in a case where the detection is successful, the processor 11 acquires the detected coordinates (position) and orientation and stores them in the storage section 12. It should be noted that the detection of the position and orientation on the basis of the image may be performed by the cart 20. Alternatively, the detection may be performed as a result of execution of firmware stored in the storage section 12 by the processor included in the device control apparatus 10.

The motion determination section 54 determines, on the basis of the position detection by the position detection section 53, whether or not the cart 20 has moved in a manner estimated from control performed by the travel control section 52. This is, in a case of the manipulated cart 20*c*, equivalent to determining, by the fact that the motion determination section 54, whether or not the manipulated cart 20*c* has moved in the manner estimated on the basis of the user manipulation. More specifically, the motion determination section 54 determines, on the basis of the position detected by the position detection section 53, whether or not the cart 20 has moved in the manner estimated from control performed by the travel control section 52, and further, the motion determination section 54 determines whether or not the position of the cart 20 has been detected by the position detection section 53.

The motion processing section 55 performs predetermined procedures in a case where it is determined that the cart 20 does not move in the estimated manner.

Figure 6:
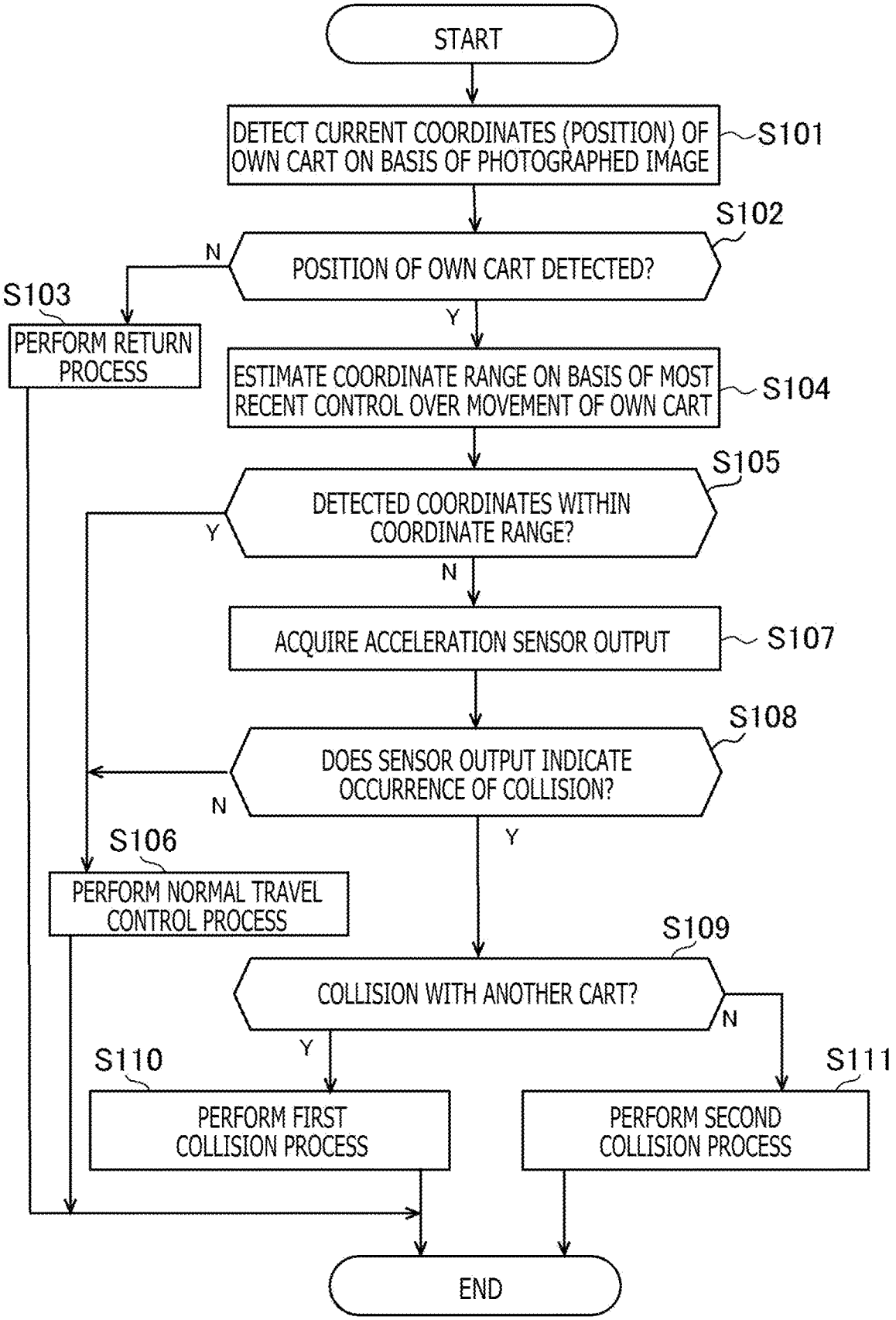
FIG. 6 is a flowchart illustrating an example of processes performed by the control system.

A more detailed description will be given below of the processes performed by this control system. FIG. 6 is a flowchart illustrating an example of the processes performed by the control system. The processes illustrated in FIG. 6 are repeated regularly for each of the plurality of carts 20. In the description given below, the cart 20 to be processed will be denoted as an own cart.

First, the position detection section 53 detects the current coordinates (position) and orientation of the own cart on the basis of the image photographed by the camera 24 (step S101). Also, the position detection section 53 acquires the detected position and orientation in a case where the above detection is successful.

Then, the motion determination section 54 determines whether or not the position of the own cart has been detected on the basis of the image in the detection performed above (step S102). In a case where the position of the own cart cannot be detected on the basis of the image (N in step S102), the own cart has been removed by hand, has gone off a course, or toppled over. Accordingly, the motion processing section 55 performs a return process for bringing the own cart back onto the sheet 31 (desirably into the travel-permitted region 35) (step S103).

Figure 7:
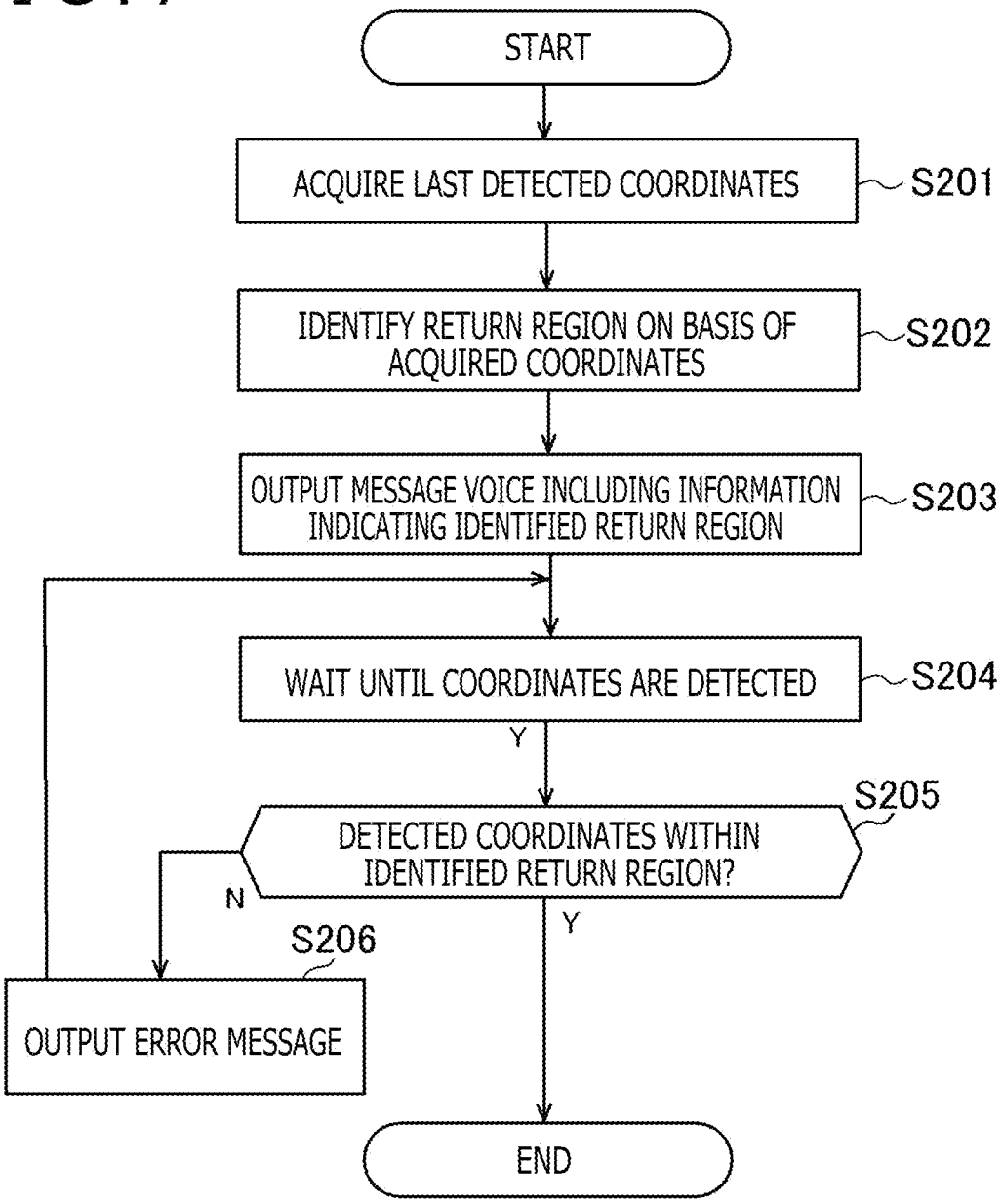
FIG. 7 is a flowchart illustrating an example of a return process.

Here, the return process will be described in detail. FIG. 7 is a flowchart illustrating an example of the return process. First, the motion processing section 55 acquires the last detected coordinates (previous coordinates) from the image acquired from the camera 24 (step S201). Next, the motion processing section 55 identifies a return region on the basis of the last detected coordinates (step S202). The return region to be identified is a region into which the cart 20 is to be brought back and may be, for example, one of the partial regions obtained by dividing the travel-permitted region 35 in FIG. 4, and the motion processing section 55 may identify the partial region including the last detected coordinates as the return region. It should be noted that the motion processing section 55 may identify a circular region having a radius r and being centered at the last detected coordinates, as the return region.

When the return region is identified, the motion processing section 55 outputs a message sound including information indicating the identified return region (step S203). The information indicating the identified return region may be, for example, the area code 37 printed in the partial region identified as the return region. It should be noted that the message may not include the information indicating the return region.

Then, the motion processing section 55 waits until the position detection section 53 detects the coordinates from the image photographed by the camera 24 of the own cart (step S204). When the position detection section 53 detects the coordinates, the motion processing section 55 determines whether the detected coordinates are located within the identified return region (step S205). In a case where the detected coordinates are located within the identified return region (Y in step S205), the process is terminated assuming that the cart has been successfully brought back, after which the processes illustrated in FIG. 6 are resumed. Meanwhile, in a case where the detected coordinates are not located within the identified return region (N in step S205), it is highly likely that cheating was committed or the location onto which the cart has been brought back is wrong. Accordingly, the motion processing section 55 outputs an error message in sound or in other forms (step S206).

Due to output of the information indicating the return region as a message, the user can readily resume the race by arranging the cart 20 in a correct region.

A description will be given below of the processes in step S102 and subsequent steps illustrated in FIG. 6. In a case where the position of the own cart is successfully detected on the basis of the image (N in step S102), the motion determination section 54 estimates a range of coordinates within which the own cart is located in a case of absence of abnormality, on the basis of the coordinates acquired during the previous process and most recent control over the movement of the own cart performed by the travel control section 52 (step S104). Then, the motion determination section 54 determines whether or not the coordinates detected by the position detection section 53 are located within the estimated coordinate range (step S105).

In a case where the detected coordinates are located within the estimated coordinate range (Y in step S105), the own cart has no difficulty in its movement caused by an external cause. Accordingly, the travel control section 52 performs a normal travel control process (step S106). The normal travel control process will be described later.

In a case where the detected coordinates are located outside the estimated coordinate range (Y in step S105), the motion determination section 54 further performs the following processes to analyze external causes. First, the motion determination section 54 acquires output (acceleration vector) of the acceleration sensor 26 incorporated in the own cart (step S107). Then, the motion determination section 54 determines whether or not the output of the acceleration sensor 26 indicates the occurrence of collision of the own cart with another object, on the basis of whether or not a magnitude of the acceleration vector acquired from the acceleration sensor 26 is greater than a given threshold (step S108). It should be noted that whether the collision has occurred may be determined on the basis of the magnitudes of components of the acceleration vector in the directions other than the vertical direction.

In a case where the output of the acceleration sensor 26 does not indicate the occurrence of collision with the other object (N in step S106), the travel control section 52 performs the normal travel control process (step S106). Meanwhile, in a case where the output of the acceleration sensor 26 indicates the occurrence of collision with the other object (Y in step S106), the motion determination section 54 further determines whether or not the collision occurred with another cart (step S109). Whether or not the collision occurred between the own cart and the other cart 20 may be determined only on the basis of whether or not the own cart and the other cart 20 are in proximity (whether or not the distance therebetween is smaller than a distance threshold) or further on the basis of whether a movement vector of the other cart 20 is oriented in the direction of approaching the own cart.

In a case where it is determined that the collision has occurred with the other cart 20 (Y in step S109), the motion processing section 55 performs a first collision process (step S110), and in a case where it is determined that the collision has not occurred with the other cart 20 (N in step S109), the motion processing section 55 performs a second collision process (step S111). The first process and the second collision process will be described in detail later.

It should be noted that the motion determination section 54 may determine whether the own cart has moved in the estimated manner in a way different from that in the processes in steps S104 and S105. For example, the motion determination section 54 may calculate an estimated movement vector on the basis of most recent control over the movement of the own cart performed by the travel control section 52, calculate a real movement vector from the current coordinates and the coordinates acquired during the previous process, and further determine whether or not a difference between the estimated movement vector and the real movement vector falls within a permissible range. Also, the motion determination section 54 may estimate the coordinates where the own cart is located in the case of the absence of abnormality, on the basis of the coordinates acquired during the last process and most recent control over the movement of the own cart performed by the travel control section 52, and the motion determination section 54 may determine whether or not the difference between the estimated coordinates and the detected current coordinates falls within the permissible range.

A description will be given next of the normal travel control process. The normal travel control process is different between the manipulated cart 20*c* that travels by a user manipulation and the controlled cart 20*d* controlled by the program.

Figure 8:
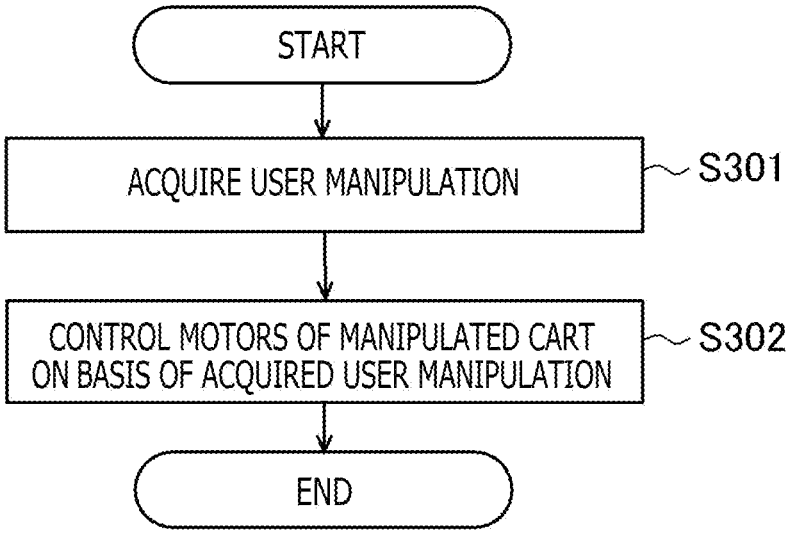
FIG. 8 is a flowchart illustrating an example of a normal travel control process of a manipulated cart.

FIG. 8 is a flowchart illustrating an example of the normal travel control process of the manipulated cart 20*c*. In a case where the own cart is the manipulated cart 20*c*, the manipulation acquisition section 51 acquires the user manipulations (steering manipulation and acceleration/deceleration manipulation) (step S301), and the travel control section 52 decides, on the basis of the acquired user manipulations, the speed and direction in which the manipulated cart 20*c* moves. The travel control section 52 controls the motors of the manipulated cart 20*c* in such a manner that the manipulated cart 20*c* travels at the decided speed and direction (step S302). In the case where the own cart is the manipulated cart 20*c*, the speed and the direction in which the manipulated cart 20*c* moves are decided by the user manipulations. Accordingly, the movement (coordinate range here) of the own cart estimated in step S104 in FIG. 6 is based on the user manipulations.

Figure 9:
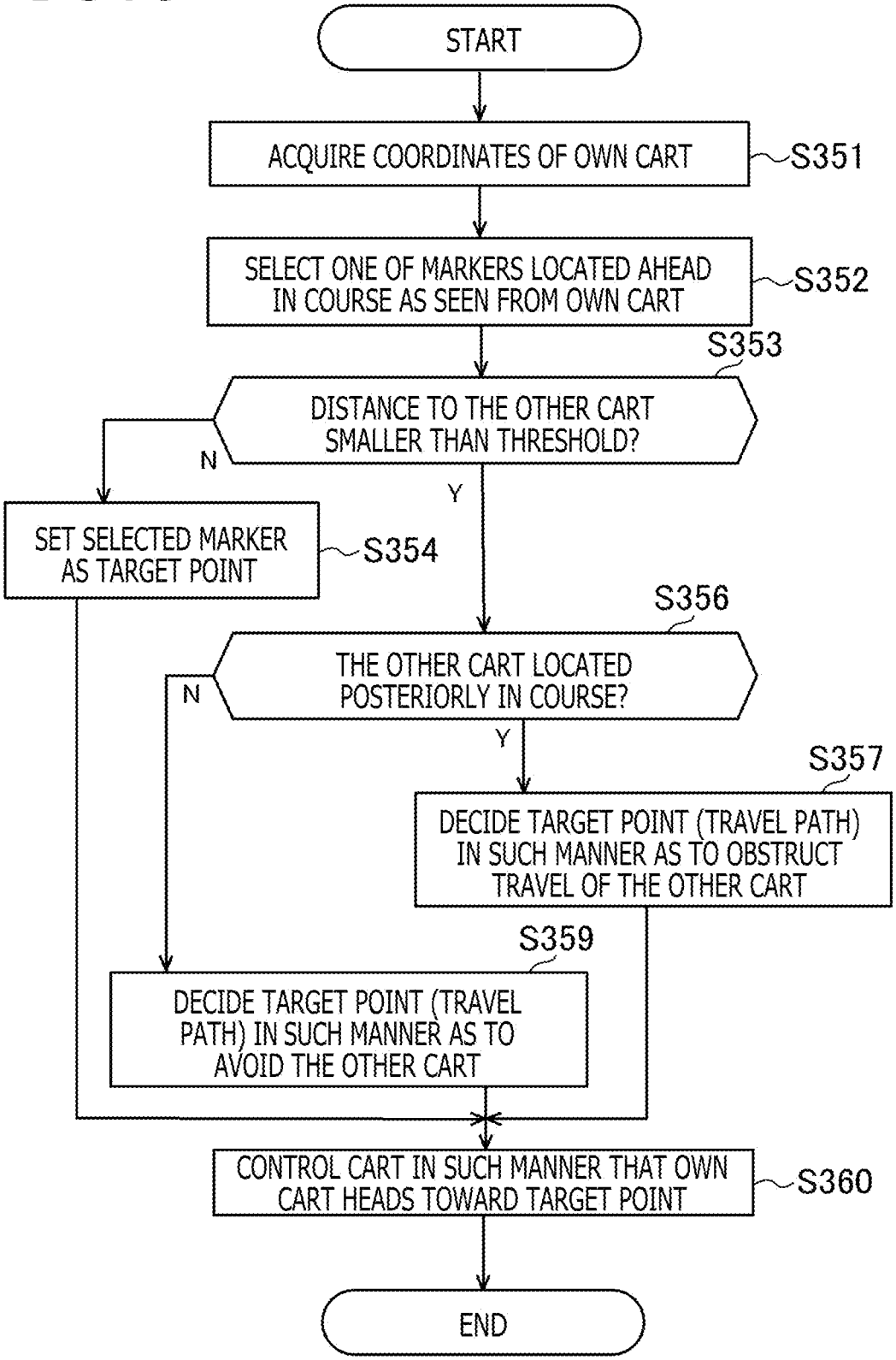
FIG. 9 is a flowchart illustrating an example of a normal travel control process of a controlled cart.

FIG. 9 is a flowchart illustrating an example of the normal travel control process of the controlled cart 20*d*. In a case where the own cart is the controlled cart 20*d*, the travel control section 52 first acquires the coordinates of the own cart (step S351). These coordinates may be the coordinates detected in step S101. Next, the travel control section 52 selects one of markers 42 (refer to FIG. 10) located ahead in the course as seen from the own cart (step S352).

Figure 10:
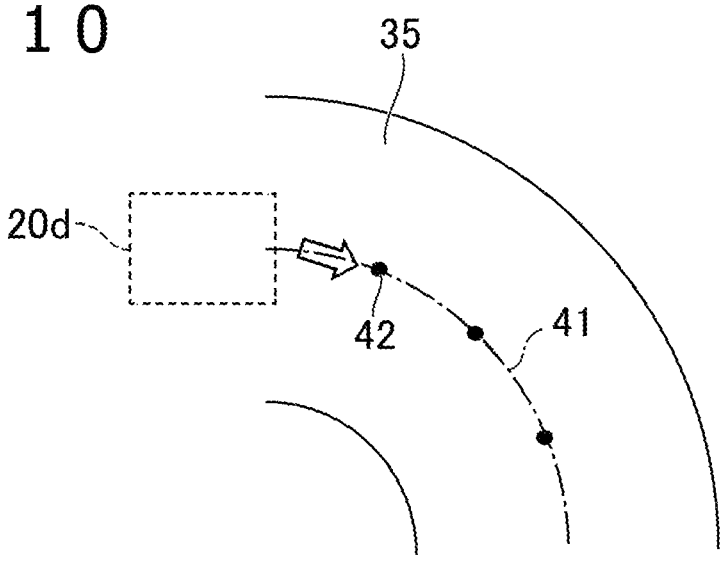
FIG. 10 is a diagram describing control over the controlled cart.

FIG. 10 is a diagram describing control over the travel of the controlled cart 20*d*. A standard route taken by the controlled cart 20*d* that travels in the travel-permitted region 35 on the sheet 31 is decided in advance and virtually depicted as a reference line 41 in FIG. 10. Also, this route is defined by the plurality of virtual markers 42 arranged on the route. In practice, the markers 42 are stored as information of point coordinates in the storage section 12. The reference line 41 is a line segment sequentially connecting the plurality of markers 42. The markers 42 are target points during travel of the controlled cart 20*d*, and, in an ideal environment, the controlled cart 20*d* is controlled in such a manner as to sequentially pass through the plurality of markers 42. It should be noted that the marker 42 selected in step S351 may be the marker 42 located at the frontmost position of the given number of markers 42 (e.g., three) closest to the controlled cart 20*d*. Alternatively, the marker 42 may be selected by obtaining the orientation of a vector extending from the own cart to the marker 42 (first orientation) and the orientation of connection of that marker 42 and the marker 42 ahead thereof and adjacent thereto (second orientation) and by ensuring that an angle formed between the first orientation and the second orientation is smaller than a given value and that the vector extending from the own cart to the marker 42 does not pass through the travel-prohibited region 36.

When the marker 42 is selected, the travel control section 52 determines whether or not the distance between the own cart and the other cart 20 (e.g., manipulated cart 20*c*) is equal to or smaller than a control threshold (step S353). In a case where the distance is greater than the control threshold (N in step S353), the selected marker is set as the target point (step S354).

Meanwhile, in a case where the distance is equal to or smaller than the control threshold (N in step S353), the travel control section 52 determines whether or not the other cart 20 is located posteriorly in the course (step S356). Whether or not the other cart 20 is located posteriorly in the course may be determined, for example, by determining whether or not an absolute value of the angle formed between a vector extending from the marker 42 closest to the own cart to the marker ahead thereof and a vector extending from the own cart to the other cart 20 is larger than a given value (e.g., a constant larger than 90 degrees but smaller than 180 degrees).

In a case where the other cart 20 is located posteriorly in the course (N in step S356), the travel control section 52 decides a target point 44 in such manner as to obstruct the travel of the other cart 20 (step S357).

Figure 11:
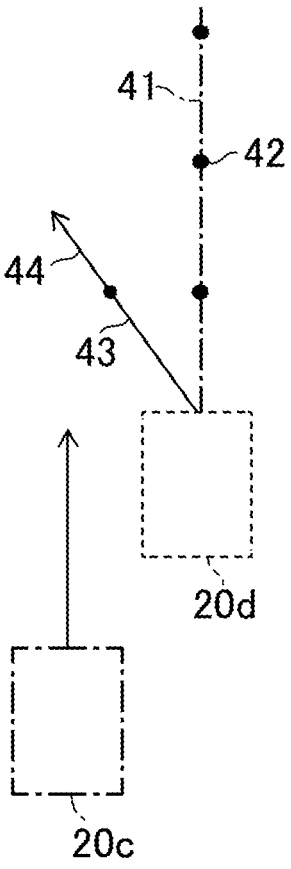
FIG. 11 is a diagram illustrating an example of a relation between a scheduled travel path of the controlled cart and the manipulated cart.

FIG. 11 is a diagram illustrating an example of a relation between a scheduled travel path of the controlled cart 20*d* and the manipulated cart 20*c*. The controlled cart 20*d* corresponds to the own cart, and the manipulated cart 20*c* corresponds to the other cart 20. In step S357, for example, the travel control section 52 calculates the current movement vector on the basis of a change in the detected coordinates of the other cart 20 and predicts a movement path of the other cart 20 from the movement vector. Then, the travel control section 52 decides, as the target point 44, the point that is closer to the predicted movement path and whose distance from the selected marker 42 is smaller than the threshold. A travel path 43 is also decided as a result of deciding the target point 44.

Also, in a case where the other cart 20 is not located posteriorly in the course (N in step S356), the travel control section 52 decides the target point 44 in such a manner that the own cart avoids the other cart 20 (step S359).

Figure 12:
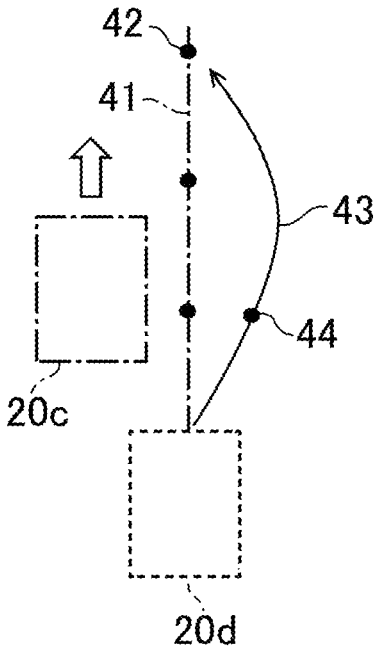
FIG. 12 is a diagram illustrating another example of the relation between the scheduled travel path of the controlled cart and the manipulated cart.

FIG. 12 is a diagram illustrating another example of the relation between the scheduled travel path of the controlled cart 20*d* and the manipulated cart 20*c*. For example, in step S359, the travel control section 52 calculates the current movement vector of the other cart 20 and predicts the movement path of the other cart 20 from the movement vector. Then, the travel control section 52 decides, as the target point 44, the point that has a predetermined distance from the predicted movement path and whose distance from the selected marker 42 is smaller than the threshold.

It should be noted that, in step S357, the travel control section 52 may also decide the target point 44 in such a manner that the own cart avoids the other cart 20. The operations in steps S357 and S359 may be changed as features of the controlled cart 20*d* by a user instruction.

When the target point 44 is set or decided, the travel control section 52 controls the motors of the own cart in such a manner that the own cart heads toward the target point 44 (step S360).

As described above, even in a case of causing the real cart 20 to travel instead of controlling a virtual cart output as an image by acquiring the coordinates detected through photographing of the sheet 31 for the own cart (controlled cart 20*d*) and the other cart 20 (manipulated cart 20*c*) and by controlling the movement of the controlled cart 20*d* on the basis of the coordinates, it becomes possible to readily detect a positional relation and perform complex control according to the positional relation between the plurality of carts 20.

Figure 14:
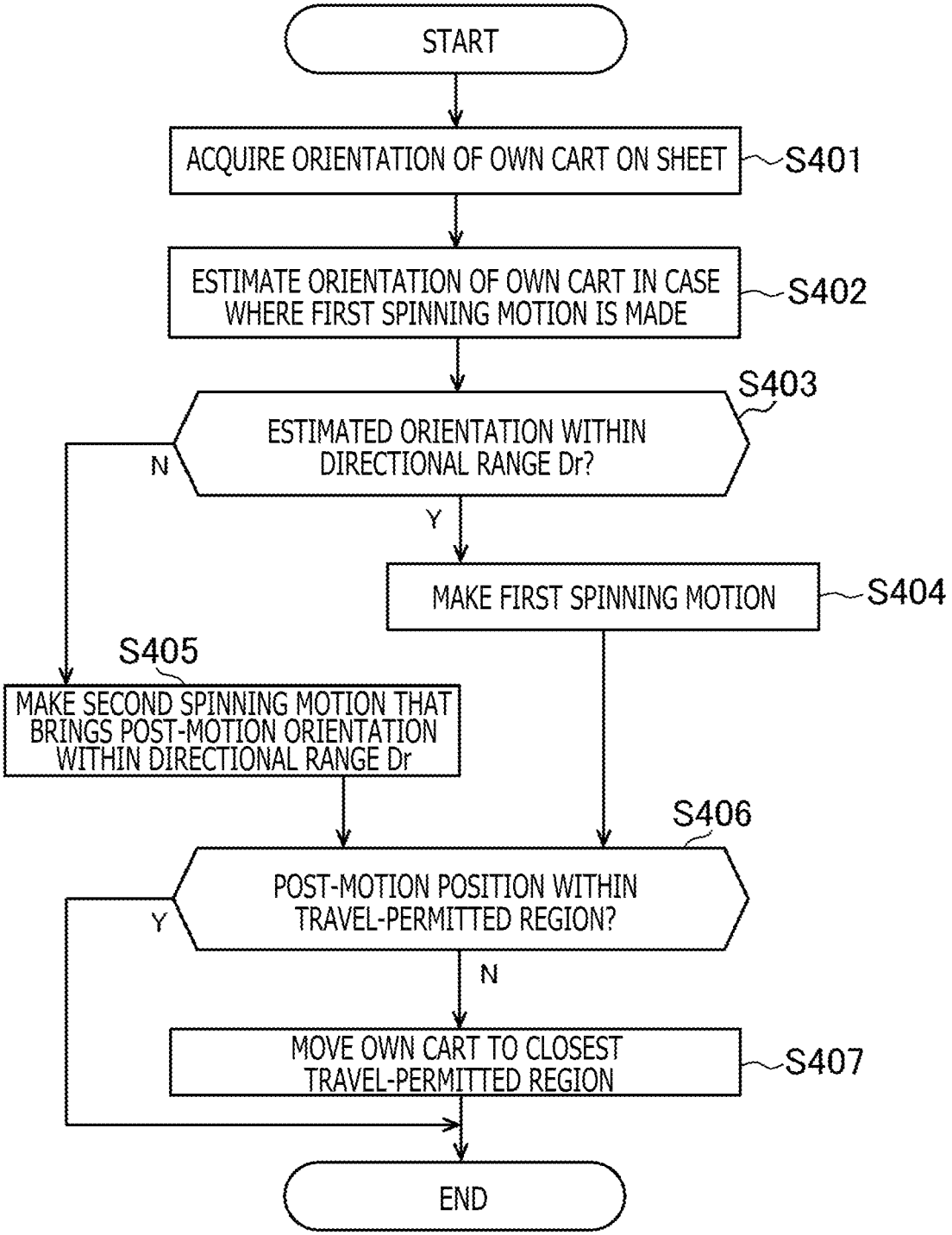
FIG. 14 is a flowchart illustrating an example of the first collision process.

A description will be given next of the first collision process. FIG. 14 is a diagram describing a spinning motion in the first collision process. In the present embodiment, in a case where it is determined that collision has occurred, the cart 20 is caused to make a motion that exaggerates the collision. In the first collision process, the motion processing section 55 controls the cart 20 in such a manner as to make a spinning motion (rotate) as illustrated in a path 75, as an exaggerated motion. Here, if an orientation 73 of the cart after the spinning motion is toward the user (falls outside a directional range Dr), there are cases where the user may become confused and perform a manipulation in the opposite direction. It should be noted that the directional range Dr is set with reference to the sheet 31 and is not related to the orientation of the cart 20 before the collision. In the present embodiment, the motion processing section 55 switches between a first spinning motion and a second spinning motion to prevent this phenomenon. A detailed description will be given of control over these motions.

Figure 13:
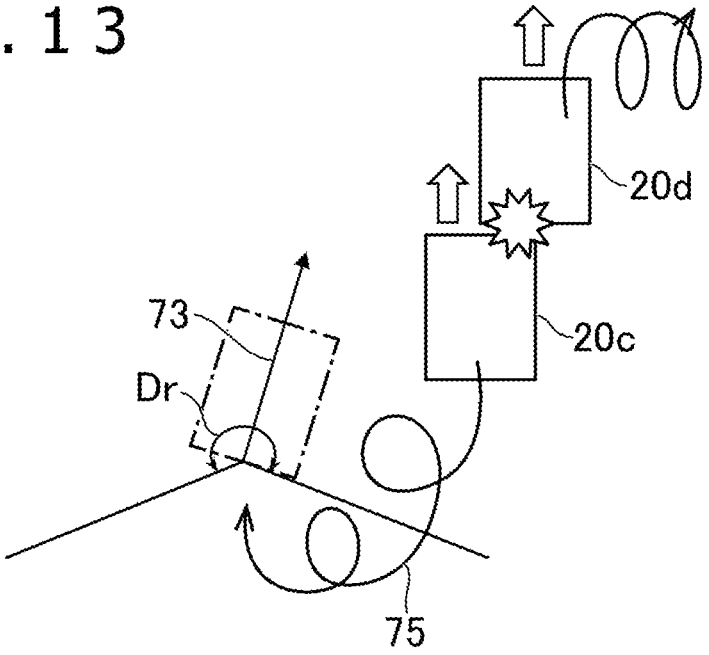
FIG. 13 is a diagram describing a spinning motion in first collision process.

FIG. 13 is a flowchart illustrating an example of the first collision process. First, the motion processing section 55 acquires the current orientation of the own cart on the sheet 31 (step S401). This orientation may be that detected in step S101.

Then, the motion processing section 55 estimates the orientation of the own cart after the first spinning motion (step S402). The motion processing section 55 may store a variation in the orientation caused by the spinning motion in the storage section 12 in advance and estimate the orientation of the own cart by adding the variation to the current orientation.

Then, in a case where the estimated orientation falls within the directional range Dr (Y in step S403), the motion processing section 55 performs the first spinning motion (step S404). It should be noted that, in this case, the cart 20 is highly likely not to face the user as a result of the first spinning motion.

Meanwhile, in a case where the estimated orientation falls outside the directional range Dr (N in step S403), the motion processing section 55 performs the second spinning motion that brings the orientation within the directional range Dr after the motion (step S405). Here, the first spinning motion and the second spinning motion differ in amount of rotation. The difference in amount of rotation between the first spinning motion and the second spinning motion is (360 degrees—Dr) or more.

Although the orientation after the spinning motion is estimated in steps S402 and S403, this determination may be made in a different way. For example, this determination may be made by storing in advance, in the storage section 12, the determination directional range obtained by adding the variation caused by the spinning motion to the directional range Dr and determining whether or not the current orientation falls within the determination directional range.

It should be noted that the motion processing section 55 may perform control in such a manner that a third spinning motion and a fourth spinning motion are performed instead of the first spinning motion and the second spinning motion further in a case where the relation between the orientation of the collision and the direction of travel satisfies a given condition.

When the first spinning motion or the second spinning motion is performed, the motion processing section 55 determines whether the post-motion position falls within the travel-permitted region 35 (step S406). In a case where the position falls outside the travel-permitted region (N in step S406), the motion processing section 55 moves the own cart to a location within the travel-permitted region 35 (step S407).

The second collision process differs from the first collision process in spinning motion and output sound. There is only a slight difference in the process itself. Accordingly, the description of a processing procedure will be omitted.

As has been described up to this point, it becomes possible to determine whether some kind of event has occurred on the cart 20 due to an external physical cause, on the basis of the detection of the coordinates by the camera 24 of the cart 20 and on the basis of the movement of the cart estimated from control over the motors of the cart and the like performed up to this point, and take an action commensurate with the event. Further, it is possible to take a more elaborate action by detecting the collision by the acceleration sensor and more properly control the game in which the physical cart is caused to travel.

Figure 15:
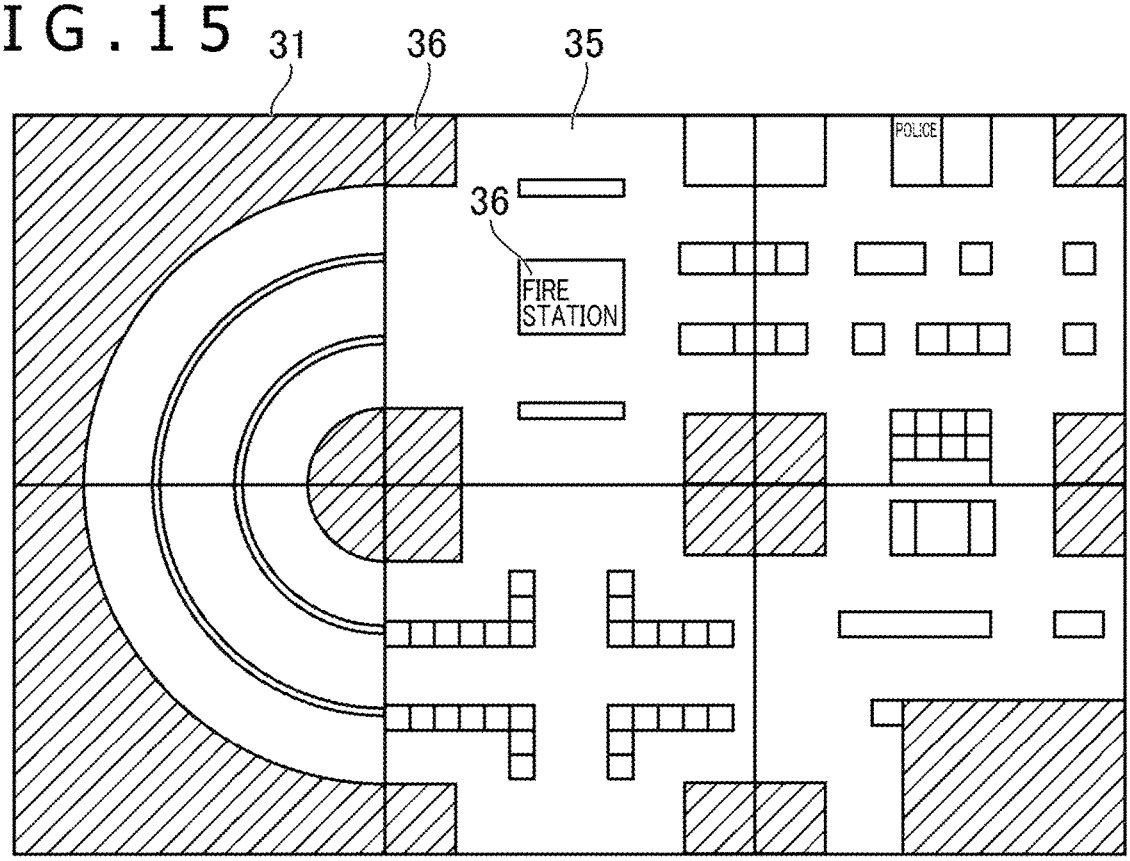
FIG. 15 is a diagram illustrating another example of the sheet.

It should be noted that the sheet 31 may be at least partially divided into a lattice as in a maze. FIG. 15 is a diagram illustrating another example of the sheet 31. In part of the sheet 31 illustrated in FIG. 15, the travel-permitted region 35 and the travel-prohibited region 36 are set in such a manner as to combine the regions divided in the form of a lattice. Even if the travel-permitted region 35 is shaped like this, it is possible to control the motion of the cart 20 by the processes described in the present embodiment or similar processes.

The invention claimed is:

1. A control system comprising:

a mobile apparatus that moves on a sheet where images indicating coordinates are arranged, the mobile apparatus including a camera to photograph at least a part of the sheet;

another mobile apparatus that moves on the sheet, the another mobile apparatus including a camera to photograph at least another part of the sheet; and a control apparatus including circuitry configured to:

acquire a manipulation of a user, perform control to cause the mobile apparatus to travel according to the manipulation of the user, detect a position of the mobile apparatus on a basis of an image photographed by the camera included in the mobile apparatus, determine, on a basis of the position detected, whether or not the mobile apparatus has moved as estimated on a basis of the manipulation of the user, perform a predetermined procedure in a case where the mobile apparatus is determined not move as estimated, control the another mobile apparatus to move along a virtual route defined by virtual markers stored in the circuitry of the control apparatus, and determine, on a basis of the position detected, whether or not the mobile apparatus has moved as estimated on the basis of the manipulation of the user, wherein the mobile apparatus further includes a sensor to detect whether or not the mobile apparatus has collided with another object, the circuitry determines, on a basis of output of the sensor, whether or not the mobile apparatus has collided with the another object, the circuitry performs a predetermined procedure in a case the mobile apparatus is determined not move as estimated and that the mobile apparatus has collided with the another object, the circuitry detects a position of the another mobile apparatus on a basis of an image photographed by the camera included in the another mobile apparatus, and the circuitry determines, on a basis of the position of the mobile apparatus manipulated by the user and the position of the another mobile apparatus, whether or not the mobile apparatus and the another mobile apparatus are in proximity to each other, performs a first procedure in a case where it is determined that the mobile apparatus does not move as estimated, that the mobile apparatus has collided with the another object, and that the mobile apparatus and the another mobile apparatus are in proximity to each other, and performs a second procedure different from the first procedure in a case where it is determined that the mobile apparatus does not move as estimated, that the mobile apparatus has collided with the another object, and that the mobile apparatus and the another object are not in proximity to each other.

2. The control system according to claim 1, wherein the circuitry performs control to cause the mobile apparatus to rotate so that an orientation of the mobile apparatus is, after rotation of the mobile apparatus, within a predetermined directional range on the sheet, in a case where the mobile apparatus is determined not move as estimated and that the mobile apparatus has collided with the another object.

3. The control system according to claim 1, wherein the circuitry determines, on a basis of detection of another position of the another mobile apparatus, whether or not the mobile apparatus has moved as estimated on the basis of the manipulation of the user, and the circuitry causes the another mobile apparatus to move on a basis of proximity between the position of the mobile apparatus manipulated by the user and the position of the another mobile apparatus, in a case where it is determined that the another mobile apparatus has moved as estimated.

4. The control system according to claim 1, wherein the circuitry determines whether or not the position of the mobile apparatus has been detected, outputs a message to instruct the user to arrange the mobile apparatus on the sheet and calculates a return range on the sheet on a basis of a last position of the mobile apparatus detected, in a case where the position of the mobile apparatus is not detected, and the circuitry outputs an error message in a case where the position of the mobile apparatus detected is not located within the return range after the instruction message has been output.

5. The control system according to claim 4, wherein a plurality of regions are printed on the sheet, and the circuitry selects, on the basis of the last position of the mobile apparatus detected, one of the plurality of regions as a return range and outputs an instruction message indicating the selected return range.

6. The control system of claim 1, wherein the circuitry of the control apparatus is configured to wirelessly communicate with the mobile apparatus and the another mobile apparatus.

7. The control system of claim 6, wherein the circuitry of the control apparatus communicates with the first mobile apparatus and the another mobile apparatus via Bluetooth protocols.

8. The control system of claim 1, wherein each of the mobile apparatus and the another mobile apparatus include servo motors and wheels to cause movement thereof on the sheet.

9. The control system of claim 1, wherein the predetermined procedure is a return procedure to bring the mobile apparatus into a travel-permitted region of the sheet.

10. The control system of claim 1, wherein the predetermined procedure includes a travel control process to set a direction of travel and a speed of travel according to the manipulation of the user.

11. The control system of claim 1, wherein the predetermined procedure includes a collision process to cause the mobile apparatus to make a spinning motion.

12. The control system of claim 1, wherein the predetermined procedure includes a second collision process to cause the mobile apparatus to output a sound in addition to the spinning motion.

13. A control method performed by circuitry of a control apparatus, comprising:

acquiring a manipulation of a user;

performing control to cause a mobile apparatus having a camera to photograph at least a part of a sheet where images indicating coordinates are arranged to travel on the sheet according to the manipulation of the user;

detecting a position of the mobile apparatus on a basis of an image photographed by the camera included in the mobile apparatus;

determining, on a basis of the position detection of the mobile apparatus, whether or not the mobile apparatus has moved as estimated on a basis of the manipulation of the user;

performing a predetermined procedure in a case where the mobile apparatus is determined not move as estimated; and controlling another mobile apparatus according to a virtual route defined by virtual markers stored in the circuitry of the control apparatus, wherein the method further includes determining, on a basis of the position detected, whether or not the mobile apparatus has moved as estimated on the basis of the manipulation of the user, the mobile apparatus further includes a sensor to detect whether or not the mobile apparatus has collided with another object, and the method further includes:

determining, on a basis of output of the sensor, whether or not the mobile apparatus has collided with the another object, performing a predetermined procedure in a case the mobile apparatus is determined not move as estimated and that the mobile apparatus has collided with the another object, detecting a position of the another mobile apparatus on a basis of an image photographed by the camera included in the another mobile apparatus, determining, on a basis of the position of the mobile apparatus manipulated by the user and the position of the another mobile apparatus, whether or not the mobile apparatus and the another mobile apparatus are in proximity to each other, performing a first procedure in a case where it is determined that the mobile apparatus does not move as estimated, that the mobile apparatus has collided with the another object, and that the mobile apparatus and the another mobile apparatus are in proximity to each other, and performing a second procedure different from the first procedure in a case where it is determined that the mobile apparatus does not move as estimated, that the mobile apparatus has collided with the another object, and that the mobile apparatus and the another object are not in proximity to each other.

14. A non-transitory computer-readable medium storing a program that, when executed by circuitry of a control apparatus, causes the circuitry of the control apparatus to perform a method comprising:

acquiring a manipulation of a user;

performing control to cause a mobile apparatus having a camera for photographing part of a sheet where images indicating coordinates are arranged to travel on the sheet according to the manipulation of the user;

controlling detection of a position of the mobile apparatus based on an image photographed by the camera included in the mobile apparatus;

determining, on a basis of the position detection, whether or not the mobile apparatus has moved as estimated on a basis of the manipulation of the user;

performing a predetermined procedure in a case where the mobile apparatus is determined not move as estimated; and controlling another mobile apparatus according to a virtual route defined by virtual markers stored in the circuitry of the control apparatus, wherein the method further includes determining, on a basis of the position detected, whether or not the mobile apparatus has moved as estimated on the basis of the manipulation of the user, the mobile apparatus further includes a sensor to detect whether or not the mobile apparatus has collided with another object, and the method further includes:

determining, on a basis of output of the sensor, whether or not the mobile apparatus has collided with the another object, performing a predetermined procedure in a case the mobile apparatus is determined not move as estimated and that the mobile apparatus has collided with the another object, detecting a position of the another mobile apparatus on a basis of an image photographed by the camera included in the another mobile apparatus, determining, on a basis of the position of the mobile apparatus manipulated by the user and the position of the another mobile apparatus, whether or not the mobile apparatus and the another mobile apparatus are in proximity to each other, performing a first procedure in a case where it is determined that the mobile apparatus does not move as estimated, that the mobile apparatus has collided with the another object, and that the mobile apparatus and the another mobile apparatus are in proximity to each other, and performing a second procedure different from the first procedure in a case where it is determined that the mobile apparatus does not move as estimated, that the mobile apparatus has collided with the another object, and that the mobile apparatus and the another object are not in proximity to each other.

15. A control system comprising:

a first apparatus and a second apparatus, each configured to travel on a sheet where images indicating coordinates are arranged and each having a camera to photograph part of the sheet; and a control apparatus including circuitry configured to:

acquire a manipulation of a user, perform control to cause the first apparatus to travel according to the manipulation of the user, detect a position of the first apparatus on a basis of an image photographed by the camera included in the first apparatus and detect a position of the second apparatus on a basis of an image photographed by the camera included in the second apparatus, control the second apparatus to travel alone a virtual route defined by virtual markers stored in the circuitry of the control apparatus, decide a destination of the second apparatus on a basis of the position of the first apparatus and the position of the second apparatus, and adjust the travel of the second apparatus alone the virtual route on a basis of the decided destination, and determine, on a basis of the position detected, whether or not the first apparatus has moved as estimated on the basis of the manipulation of the user, wherein the first apparatus further includes a sensor to detect whether or not the first apparatus has collided with another object, the circuitry determines, on a basis of output of the sensor, whether or not the first apparatus has collided with the another object, the circuitry performs a predetermined procedure in a case the first apparatus is determined not move as estimated and that the first apparatus has collided with the another object, the circuitry detects a position of the second mobile apparatus on a basis of an image photographed by the camera included in the second mobile apparatus, and the circuitry determines, on a basis of the position of the first apparatus manipulated by the user and the position of the second mobile apparatus, whether or not the first apparatus and the second mobile apparatus are in proximity to each other, performs a first procedure in a case where it is determined that the first apparatus does not move as estimated, that the first apparatus has collided with the another object, and that the first apparatus and the second mobile apparatus are in proximity to each other, and performs a second procedure different from the first procedure in a case where it is determined that the first apparatus does not move as estimated, that the first apparatus has collided with the another object, and that the second apparatus and the another object apparatus are not in proximity to each other.

16. The control system of claim 15, wherein the second apparatus further includes a sensor to detect collision with another object, and the circuitry controls the travel of the second apparatus further on a basis of a signal of the sensor.

* * * * *